US008950045B2

(12) United States Patent
Anzini et al.

(10) Patent No.: US 8,950,045 B2
(45) Date of Patent: Feb. 10, 2015

(54) HIGH BURST LEAK-RESISTANT SLIDER ZIPPER SYSTEM

(75) Inventors: David J. Anzini, Middletown, NY (US); Rusty Koenigkramer, Nanuet, NY (US)

(73) Assignee: Illinois Tool Works Inc., Glenview, IL (US)

( * ) Notice: Subject to any disclaimer, the term of this patent is extended or adjusted under 35 U.S.C. 154(b) by 152 days.

(21) Appl. No.: 13/192,515

(22) Filed: Jul. 28, 2011

(65) Prior Publication Data

US 2012/0186048 A1 Jul. 26, 2012

Related U.S. Application Data

(60) Provisional application No. 61/368,438, filed on Jul. 28, 2010.

(51) Int. Cl.
*A44B 19/16* (2006.01)
*B65D 33/25* (2006.01)

(52) U.S. Cl.
CPC ..... *B65D 33/2591* (2013.01)
USPC ..... 24/400; 24/585.12; 383/64; 383/65

(58) Field of Classification Search
USPC ..... 24/399, 400, 585.12; 383/63, 64, 65; 53/133.4, 139.2
See application file for complete search history.

(56) References Cited

U.S. PATENT DOCUMENTS

| | | | | |
|---|---|---|---|---|
| 3,054,434 | A | 9/1962 | Ausnit et al. | |
| 3,122,807 | A * | 3/1964 | Ausnit | 24/399 |
| 3,173,184 | A | 3/1965 | Ausnit | |
| 3,220,076 | A * | 11/1965 | Ausnit et al. | 24/399 |
| 3,259,951 | A | 7/1966 | Zimmerman | |
| 5,301,395 | A | 4/1994 | Richardson et al. | |
| 6,185,796 | B1 | 2/2001 | Ausnit | |
| 6,481,980 | B1 | 11/2002 | Vandlik et al. | |
| 6,571,430 | B1 | 6/2003 | Savicki et al. | |
| 7,159,282 | B2 | 1/2007 | Blythe et al. | |
| 7,416,338 | B2 * | 8/2008 | Ausnit | 383/64 |
| 7,849,565 | B2 * | 12/2010 | Swain et al. | 24/30.5 R |
| 2003/0162643 | A1 * | 8/2003 | Tomic | 493/394 |
| 2007/0258665 | A1 | 11/2007 | Greco et al. | |
| 2008/0313863 | A1 * | 12/2008 | Swain et al. | 24/30.5 R |
| 2011/0308050 | A1 * | 12/2011 | Swain et al. | 24/415 |

* cited by examiner

*Primary Examiner* — Robert J Sandy
*Assistant Examiner* — Michael Lee
(74) *Attorney, Agent, or Firm* — McCarter & English, LLP

(57) ABSTRACT

The disclosure pertains to a slider zipper which includes first and second zipper profiles, typically a hinged profile and an non-hinged profile, with first and second ears extending above the respective first and second zipper profiles. A slider rides above the zipper profiles and opens the zipper by separating the ears. Typically, the slider is configured to push the non-hinged zipper profile away from the hinged zipper profiles. Similarly, typically, the ear on the non-hinged zipper profile is stiffer than the ear on the hinged zipper profile.

16 Claims, 3 Drawing Sheets

HIGH BURST LEAK-RESISTANT SLIDER ZIPPER SYSTEM

This application claims priority under 35 U.S.C. §119(e) of U.S. provisional application Ser. No. 61/368,438 filed Jul. 28, 2010, the disclosure of which is hereby incorporated by reference in its entirety.

BACKGROUND OF THE DISCLOSURE

1. Field of the Disclosure

The present disclosure relates to a slider zipper for a reclosable package. More particularly, the slider zipper typically is leak-resistant and achieves a high burst strength (i.e., a high force is required to separate the zipper profiles).

2. Description of the Prior Art

While slider zippers are typically well-received by the consumer, many manufacturers find the slider zipper to be too costly and inefficient in their manufacturing process to continue to be viable. Manufacturers may seek improvements in the slider zippers with respect to internal opening force (i.e., burst strength); ability to stay closed over tight radius rollers during conversion; end stomp pull off forces; reduced hermeticity in response to clip or profile preactivation; leakage caused by portions of the clip or slider extending through the zipper profile; and difficulties in duplex installation, due to clip insertion issues.

OBJECTS AND SUMMARY OF THE DISCLOSURE

It is therefore an object of the present disclosure to provide a slider zipper for a reclosable package which is leak-resistant and achieves a high burst strength.

It is therefore a further object of the present disclosure to reduce the concerns or disadvantages which may be associated with some prior art slider zipper designs.

These and other objects are attained by providing a slider zipper with stiff ears added to the top (consumer side) of the zipper profiles of a zipper, typically a zipper with one hinged profile and one non-hinged profile. The slider clip includes a plow that rides above the profiles and between the ears. As the clip slides along the zipper in the opening direction, the plow pushes the ears apart, opening the zipper. Typically, the plow is designed to push preferentially the non-hinged side of the zipper out and away from the center-line of the zipper.

BRIEF DESCRIPTION OF THE DRAWINGS

Further objects and advantages of the invention will become apparent from the following description and from the accompanying drawing, wherein.

DETAILED DESCRIPTION OF THE PREFERRED EMBODIMENTS

Figure 1:
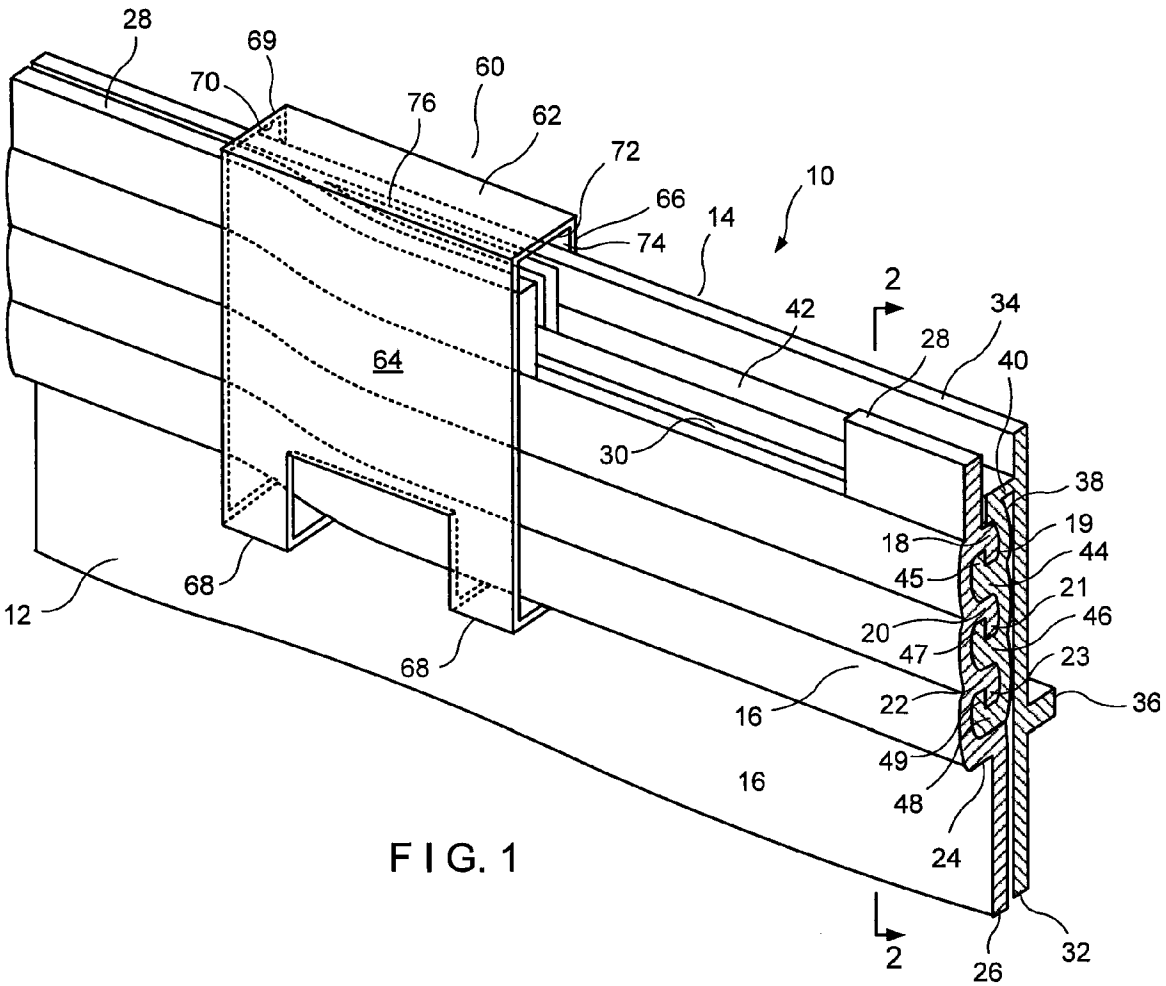
FIG. 1 is perspective view of the slider zipper of the present disclosure.
Figure 3:
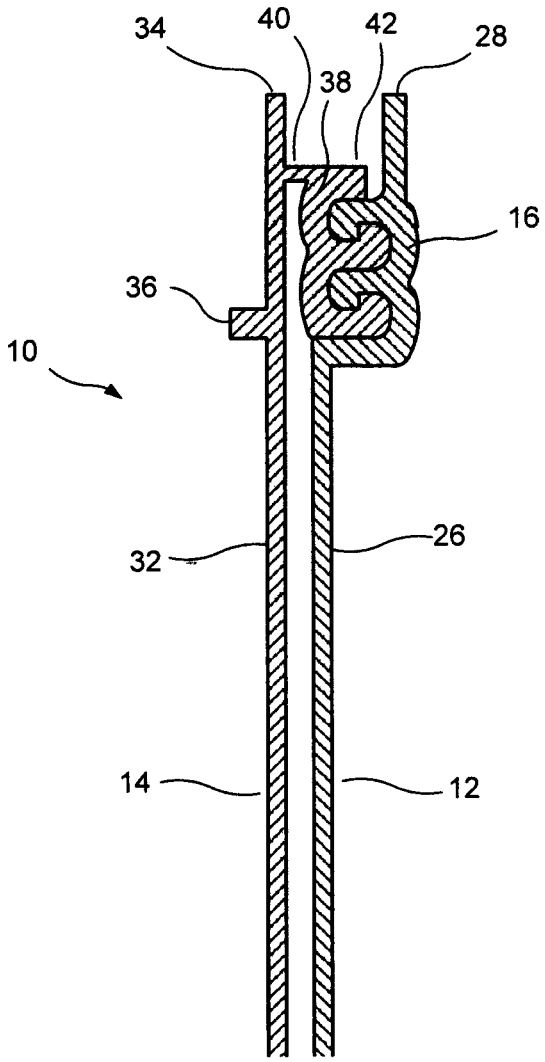
FIG. 3 is an alternative cross-sectional view along plane 2-2 of FIG. 1.

Referring now to the drawings in detail wherein like numerals indicate like elements throughout the several views, one sees that in FIG. 1 is a perspective view of slider zipper 10. Slider zipper 10, typically made of polymeric material, includes first zipper profile 12 which reclosably interlocks with second zipper profile 14. First zipper profile 12 includes first interlocking element 16 with first, second and third interlocking arms 18, 20, 22 terminating in respective first, second and third detent elements 19, 21, 23. Embodiments with two interlocking arms are also envisioned as shown in FIG. 3. Inverted ledge element 24 is formed underneath third interlocking arm 22, with first flange 26 extending downwardly therefrom intended to be engaged by the slider 60, in order to retain the slider 60 on the slider zipper 10. In the first zipper profile 12, first interlocking element 16 is typically not hinged. First zipper profile 12 further includes first ear 28 extending upwardly therefrom (i.e., extending in the consumer side direction) along the length zipper 10. First ear 28 further includes gap (or discontinuity) 30 which forms a parking station for slider 60. Typically, gap 30 is formed in only one ear, so as to maintain slider 60 in the proper position in the parking station.

Figure 2:
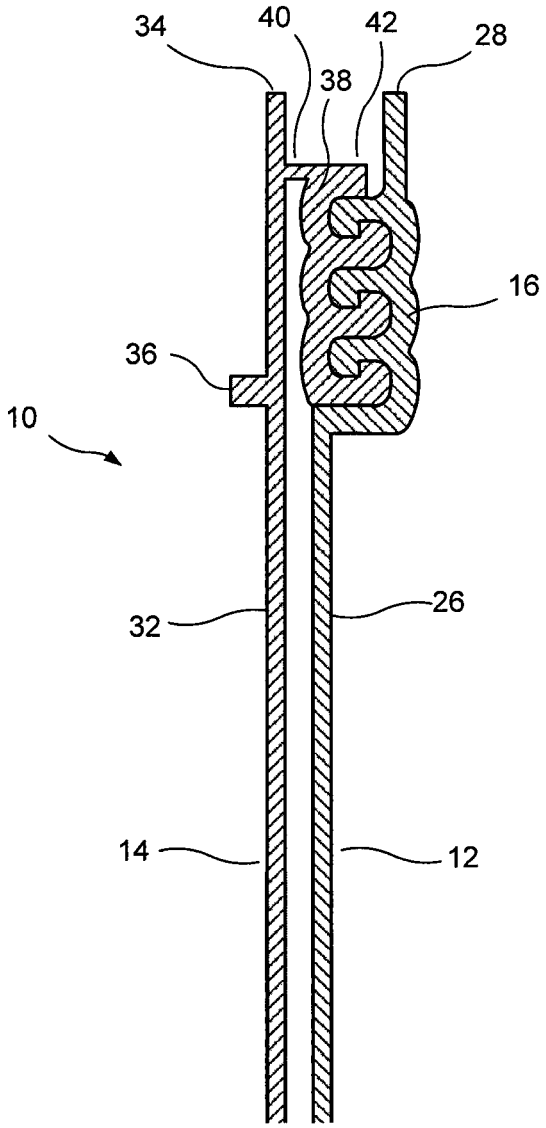
FIG. 2 is a cross-sectional view along plane 2-2 of FIG. 1.

Second zipper profile 14 includes second flange 32 which extends along the side of second zipper profile 14 and terminates on its upward side in second ear 34 with is formed parallel with first ear 28. Rail 36 extends perpendicularly from second flange 32 and is slidably engaged by slider clip 60 in order to keep the slider 60 on the zipper profiles 12, 14. Alternately, second flange 32 can be connected more to the inboard edge of the zipper profile, creating an indentation on which the slider 60 can rest as shown in FIG. 2. Second interlocking element 38 includes upper surface 42 which is positioned between the first and second ears 28, 34, and further includes fourth, fifth and sixth interlocking arms 44, 46, 48 terminating in respective fourth, fifth and sixth detent elements 45, 47, 49. In the interlocked position, fourth interlocking arm 44 is engaged and interlocked between first and second interlocking arms 18, 20, fifth interlocking arm 46 is engaged and interlocked between second and third interlocking arms 20, 22, and sixth interlocking arm is engaged and interlocked between third interlocking 22 and inverted ledge element 24. Second interlocking element 38 is hinged to second flange 32 at hinge point 40. This hinging is typically achieved by integral extrusion of the second zipper profile 14 (including second flange 32, second ear 34, second interlocking element 38 and hinge point 40). The hinge construction typically provides for a higher burst strength configuration.

First and second flanges 26, 32 are configured for attachment to respective first and second walls of a reclosable package (not shown).

Slider 60 includes a top wall 62, and first and second sidewalls 64, 66. First sidewall 64 terminates with clip portions 68 that engage inverted ledge element 24. Similarly, second sidewall 66 terminates with clip portions that engage rail 36. Slider 60 further includes closing end 69 with a relatively narrower opening 70. That is, when slider 60 is moved toward the right (i.e., the closing direction) in the orientation shown in FIG. 1, the first and second zipper profiles 12, 14 exiting from relatively narrower opening 70 are in the interlocked or closed configuration. Slider 60 likewise includes opening end 72 with a relatively wider opening 74, with plow 76 extending from the interior of top wall 62 between first and second ears 28, 34. In this configuration, when slider 60 is moved toward the left (i.e., the opening direction) in the orientation shown in FIG. 1, plow 76 rides above the first and second zipper profiles 12, 14 and separates the first and second ears 28, 34, thereby separating the first and second zipper profiles 12, 14 which exit from relatively wider opening 74. Plow 76 is designed to push the non-hinged first zipper profile 12 away from the hinged second zipper profile 14 thereby separating first and second interlocking elements 16, 38 from each other. Similarly, when slider 60 is moved toward the right (i.e., the closing direction) in the orientation shown in FIG. 1, the first and second ears 28, 34 are moved toward each other by the structure of relatively narrower opening 70 of closing end 69 of the slider 60, thereby interlocking the first and second interlocking elements 16, 38. Slider 60 can be moved to the relatively right position in the orientation shown in FIG. 1, so as to be within the parking station formed by gap 30. As the slider 60 is slid to the relatively right position, the plow 76 enters the gap 30 where the first ear 28 is notched out (whereby plow 76 no longer separates first and second ears 28, 34 from each other), the slider 60 enters and becomes parked within the parking station formed by gap 30 and the zipper profiles 12, 14 typically will be totally interlocked with each other. In view of the high contact areas of the first and second interlocking elements 16, 38, the zipper 10 can be expected to be very leak-resistant in this closed configuration.

First and second ears 28, 34 are intended to be relatively stiff in order to aid in the operation of the slider 60. Typically, first ear 28 (the ear on the non-hinged profile) is intended to be significantly stiffer than second ear 34 (the ear on the hinged profile), so that the non-hinged side of the zipper 10 has increased leverage when the plow 76 of the slider 60 urges against the first ear 28. First and second ears 28, 30 can be stiffened through the use of stiff resins such as high density polyethylene, polypropylene, Topas, mineral-filled polymers, or other high modulus material. Additionally, increased stiffness can be achieved by thickening the ear. Similarly, rail 36 is typically formed of the above-identified relatively stiff materials. The resulting zipper 10 is typically fully scalable through a range of sizes for light, medium and heavy duty applications.

By way of the disclosed structure, it is envisioned that it will be possible to achieve a leak-resistant slider-operated zipper wherein the burst strength per linear inch may be three times the zipper weight per one thousand feet; the joined interlocking elements measure between 68 and 74 thousandths of an inch in height and wherein the burst strength is at least 16 pounds per linear inch; and wherein the zipper weighs no more than 5.5 pounds per 1000 feet. As a result, a small, inexpensive slider zipper with high-burst strength and leak-resistant features is achieved. It is believed that this combination of characteristics has not been satisfactorily achieved in the prior art.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A leak-resistant zipper for a reclosable package, including:

a first zipper profile including a first interlocking element and a first flange, and further including a first ear portion extending therefrom;

a second zipper profile including a second interlocking element and a second flange, and further including a second ear portion extending therefrom, wherein the second interlocking element is in a hinged relationship with the second flange, and wherein the first ear portion is stiffer than the second ear portion;

a slider including a plow between the first and second ear portions, the plow entirely above the first and second interlocking elements for separating the first and second interlocking elements from each other engaging the first and second ear portions, the slider separating the first and second ear portions, thereby separating the first and second interlocking elements from each other, when moved in a first direction, the slider urging the first and second ear portions toward each other, thereby interlocking the first and second interlocking elements, when moved in a second direction; and the first ear portion including a gap for forming a parking station for the slider, and wherein the second ear portion is free of a gap for forming a parking station.

2. The zipper of claim 1 wherein a burst strength per linear inch is three times the zipper weight per one thousand feet of zipper length.

3. The zipper of claim 1 wherein the first and second zipper profiles, when joined, measure between 68 and 74 thousandths of an inch in height and wherein a burst strength is at least 16 pounds per linear inch of zipper.

4. The zipper of claim 1 wherein a burst strength is at least 16 pounds per linear inch and the zipper weighs no more than 5.5 pounds per 1000 feet.

5. The zipper of claim 1 wherein the slider includes an upper wall and first and second sidewalls, and wherein the plow extends from an interior surface of the upper wall.

6. The zipper of claim 1 wherein the plow is configured to push the first ear portion away from the second ear portion when moved in the first direction.

7. The zipper of claim 1 wherein the zipper is fully closed when the slider is parked within the parking station.

8. The zipper of claim 1 wherein the zipper is made from polymeric material.

9. A leak-resistant zipper, including:

a first zipper profile including a first interlocking element, and further including a first ear portion extending therefrom;

a second zipper profile including a second interlocking element, and further including a second ear portion extending therefrom, wherein the second interlocking element is hinged with respect to the second ear portion, and wherein the first ear portion is stiffer than the second ear portion;

a slider including a plow between the first and second ear portions, the plow entirely above the first and second interlocking elements for separating the first and second interlocking elements from each other engaging the first and second ear portions, the slider pulling the first ear portion away from the second ear portion, thereby separating the first and second interlocking elements from each other, when moved in a first direction, the slider urging the first and second ear portions toward each other, thereby interlocking the first and second interlocking elements, when moved in a second direction; and the first ear portion including a gap for forming a parking station for the slider, and wherein the second ear portion is free of a gap for forming a parking station.

10. The zipper of claim 9 wherein a burst strength per linear inch is three times the zipper weight per one thousand feet of zipper length.

11. The zipper of claim 9 wherein the first and second zipper profiles, when joined, measure between 68 and 74 thousandths of an inch in height and wherein a burst strength is at least 16 pounds per linear inch of zipper.

12. The zipper of claim 9 wherein a burst strength is at least 16 pounds per linear inch and the zipper weighs no more than 5.5 pounds per 1000 feet.

13. The zipper of claim 9 wherein the slider includes an upper wall and first and second sidewalls, and wherein the plow extends from an interior surface of the upper wall.

14. The zipper of claim 9 wherein the zipper is fully closed when the slider is parked within the parking station.

15. The zipper of claim 9 wherein the second zipper profile includes a rail which is slidably engaged by the slider.

16. The zipper of claim 9 wherein the zipper is made from polymeric material.

* * * * *